US005967475A

United States Patent [19]

Johnson

[11] Patent Number: 5,967,475

[45] Date of Patent: Oct. 19, 1999

[54] HUNTING BOW HANGER

[76] Inventor: Bobby W. Johnson, 19096 Baron Dr., W., Mobile, Ala. 36618

[21] Appl. No.: 09/134,682

[22] Filed: Aug. 14, 1998

[51] Int. Cl.[6] ..... A47B 96/06

[52] U.S. Cl. ..... 248/217.4; 248/230.1; 182/92; 124/88

[58] Field of Search ..... 248/309.1, 217.4, 248/230.1, 216.1, 216.4, 218.4, 230.8, 314, 546; 182/92, 91; 124/88, 23.1; 411/389, 392, 401

[56] References Cited

U.S. PATENT DOCUMENTS

| | | | |
|---|---|---|---|
| 907,483 | 12/1908 | Ette | 340/825.06 |
| 3,380,697 | 4/1968 | Melcher | 248/216 |
| 3,985,204 | 10/1976 | Lattig | 182/223 |
| 4,413,706 | 11/1983 | Michael | 182/91 |
| 4,669,575 | 6/1987 | Skyba | 182/92 |
| 5,044,582 | 9/1991 | Walters | 248/57 |
| 5,076,522 | 12/1991 | Stinson | 248/216.1 |
| 5,114,107 | 5/1992 | Mahn et al. | 248/217.4 |
| 5,240,211 | 8/1993 | Anderson | 248/125 |
| 5,269,395 | 12/1993 | Lyzhoft et al. | 182/187 |
| 5,310,151 | 5/1994 | Engel | 248/231 |
| 5,482,241 | 1/1996 | Oglesby | 248/309.1 |
| 5,626,322 | 5/1997 | Braun | 248/282.1 |
| 5,630,568 | 5/1997 | Lubrecht | 248/217.4 |
| 5,669,592 | 9/1997 | Kearful | 248/217.4 |
| 5,743,353 | 4/1998 | Browning et al. | 182/192 |
| 5,857,651 | 1/1999 | Kunevicius | 248/230.8 |
| 5,881,837 | 3/1999 | Leicht | 182/92 |

*Primary Examiner*—Ramon O. Ramirez
*Assistant Examiner*—Tan Le
*Attorney, Agent, or Firm*—Joseph N. Breaux

[57] ABSTRACT

A Hunting Bow Hanging apparatus attachable to a tree or post comprising an "L"-shaped bracket with a lag bolt permanently attached extending from one end of the "L"-shaped bracket and screwable secured to a tree. A square aluminum outer tube is attached to the other end of the "L"-shaped bracket and has holes drilled down its length to allow for adjustment of a square aluminum inner tube insertable therein which has holes drilled that correspond to the holes of the outer tube. A locking bolt and/or pin is insertable through the holes of the outer and inner tubes to allow for length adjustment and securing of the inner tube. A hunting bow mounting bracket is provided at the end of the inner extension tube for connecting the bow or any other article to the apparatus.

1 Claim, 2 Drawing Sheets

HUNTING BOW HANGER

TECHNICAL FIELD

The present invention relates to devices and methods for holding and supporting hunting bows and more particularly to devices and methods for a hunting bow hanging tree stand assembly comprising an "L"-shaped bracket with a lag bolt permanently attached extending from one end of the "L"-shaped bracket and insertable or screwable into a tree; a square aluminum outer tube attached to the other end of the "L" shaped bracket and having holes drilled down its length; a square aluminum inner tube having holes drilled that correspond to the holes in the outer tube; a locking pin insertable through the holes of the outer and inner tubes to allow for length adjustment of the device, a pivoting mounting bracket is provided at the end of the extending tube for connecting the hunting bow to the apparatus.

BACKGROUND ART

In order to successfully hunt, a bow hunter must sit extremely still for long periods of time waiting for prey to walk within range. Any movement of the bow hunter will startle the prey and spoil the hunt. Normally, when prey is within range the hunter must ready him or her self by retrieving the bow and getting into position. The present invention allows a hunter's bow to hang directly in front or to a side at all times in a ready position thereby reducing the movement of a hunter. The device is length adjustable so that the bow can be placed in a location that helps illuminate movement when the hunter must ready for the bow. The present device limits movement of the hunter as much as possible thereby resulting in a more successful hunting.

Numerous prior patents have been obtained for securing hunting bows, cameras, and steps as follows:

Kearful, U.S. Pat. No. 5,669,592 which discloses a camera support for supporting a camera which is threadably secured to a tree or post. This device is extremely useful for camera however it is unapplicable for use as a bow hanging apparatus as the present invention.

Oglesby, U.S. Pat. No. 5,482,241 which discloses an archery bow support attachable to a tree or post. This invention is extremely useful however the hanger support for the Oglesby device does not allow the hanging bow to be easily moved in direction if necessary.

Mahn, et al, U.S. Pat. No. 5,144,107 discloses an apparatus for supporting archery equipment. This device is useful for its stated purposes however it is not easily adapted for hanging numerous types of bows as the present invention and does not provide an inexpensive and easy to use device as the present invention.

Stinson, U.S. Pat. No. 5,076,522 discloses a detachable mount of arrow quivers. This device is useful for mounting arrow quivers however it is inapplicable for use as a bow hanging device as the present invention.

Melcher, U.S. Pat. No. 3,380,697 discloses portable steps for climbing trees or poles with a pivotal lag bolt attachment. This device is useful for attaching portable steps to a tree or post and utilizing a similar attachment means as the present invention. The Melcher device is not adjustable in length as the present invention and does not include a bow hanging attachment mechanism as the present invention which overcomes the problems that a bow hunter experiences when attempting to retrieve his/her weapon when an animal is near. The invention minimizes the movement of the hunter by providing a hanging means for a hunter's bow so that the hunter's bow is in a ready position thereby reducing the amount of movement the hunter must go through to ready the weapon.

GENERAL SUMMARY DISCUSSION OF INVENTION

It is thus an object of the invention to provide a Hunting Bow Hanger that is attachable to a tree or post and which comprises an "L"-shaped bracket with a permanently attached lag bolt extending from one end of the "L"-shaped bracket which is insertable or screwable into a tree or post; a square aluminum outer tube outer tube extending from the other end of "L"-shaped bracket and having holes drilled down its length, a square aluminum inner tube having holes drilled that correspond to the holes of the outer tube; a locking pin insertable through the holes of the outer and inner tubes to allow for length adjustment of the inner tube and for securing the inner tube in place; a pivotal mounting bracket attached to an end of the inner tube for connecting a hunting bow in various orientations.

It is a further object of the invention to provide a Hunting Bow Hanger that provides a hanging apparatus for hanging a hunting bow in front of or to the side of a hunter.

It is a still further object of the invention to provide a Hunting Bow Hanger that supports a hunting bow in a position which minimizes the movement of the hunter thereby resulting in more successful hunting.

It is a still further object of the invention to provide a Hunting Bow Hanger that frees the hands of the hunter so that the hunter may perform animal calls thereby luring animals to the hunter's location within range and further minimizing movement of the hunter when readying his/her weapon when the prey is near.

Accordingly, a Hunting Bow Hanger is provided for minimizing the movement of the hunter, freeing the hands of the hunter for other uses, maintaining the hunting bow in a readily available location wherein the hunting bow hanger comprises an "L"-shaped bracket with a lag bolt permanently attached thereto and extending from one end of the "L"-shaped bracket and which is insertable or screwable into a tree or post, a square aluminum outer tube extending from the other end of the "L"-shaped bracket and having holes drilled down its length to allow for length adjustment with a inner square aluminum tube having holes drilled that would correspond to the holes in the outer tube, a securing pin insertable through the holes of the inner and outer tubes to allow for length adjustment securing, and a bow mounting bracket pivotally secured at the end of the inner tube for connecting the bow.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that a bow hunter or any other hunter, would mount the hunting bow hanger to a tree or post by using a twisting motion to screw the permanently attached lag bolt until the "L"-shaped rests against the tree trunk. The user would then adjust the hunting bow hanger length by removing the securing pin and sliding the inner tube to a desired position. The securing pin would then be reinserted thereby locking the inner tube into position. The user would then hang his/her bow, rifle, or other gear onto the bow hanger, which would provide a hanging location to keep needed items within easy reach of the hunter minimizing movement needed to retrieve a bow, rifle, or any other accessories. A pivoting bracket provided at the end of the inner tube allows the bow to hang in various orientations depending on the placement of the hunting bow, hanger, and the hunter.

Figure 1:
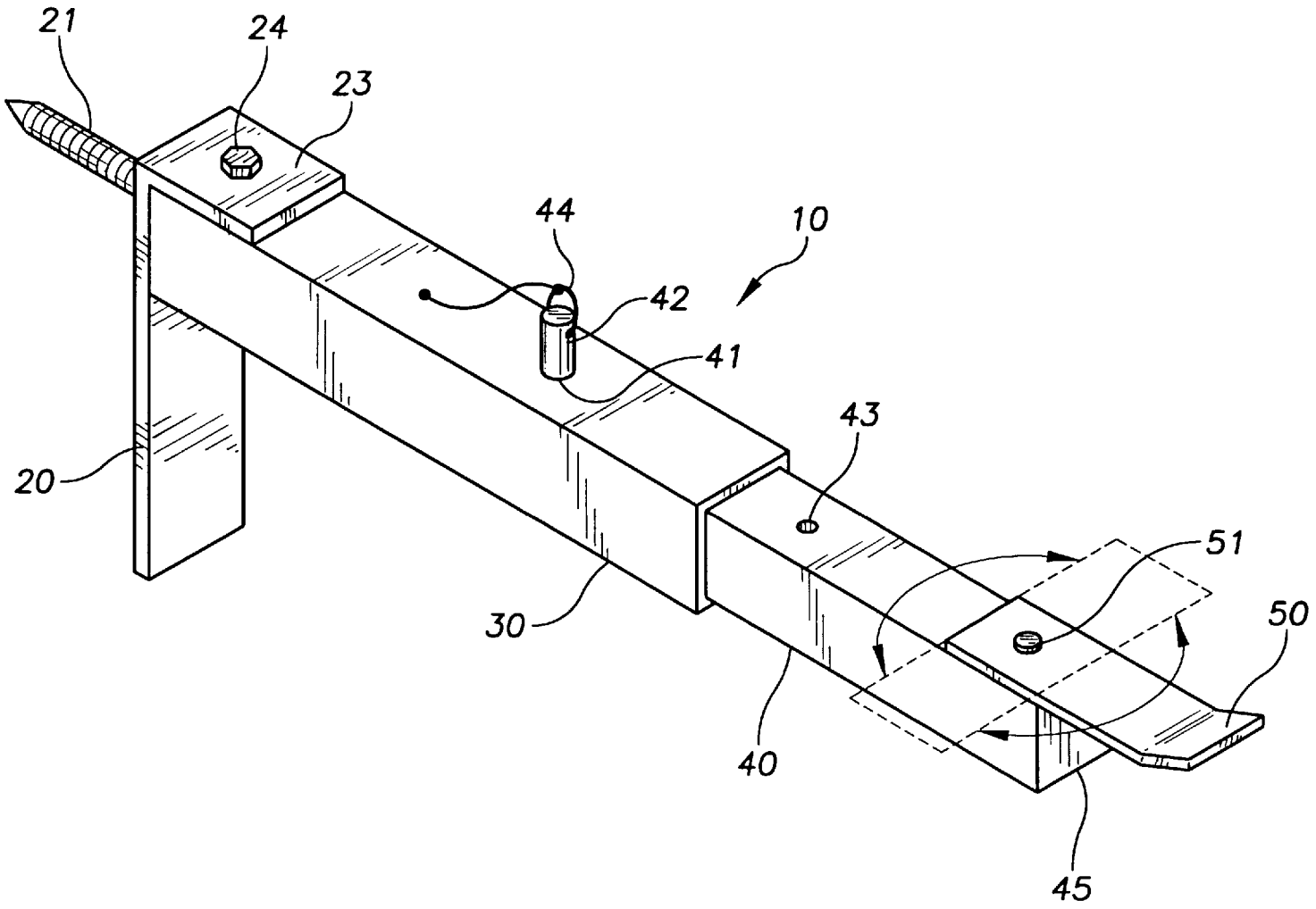
FIG. 1 is an isometric view of the bow hanging apparatus.
Figure 2:
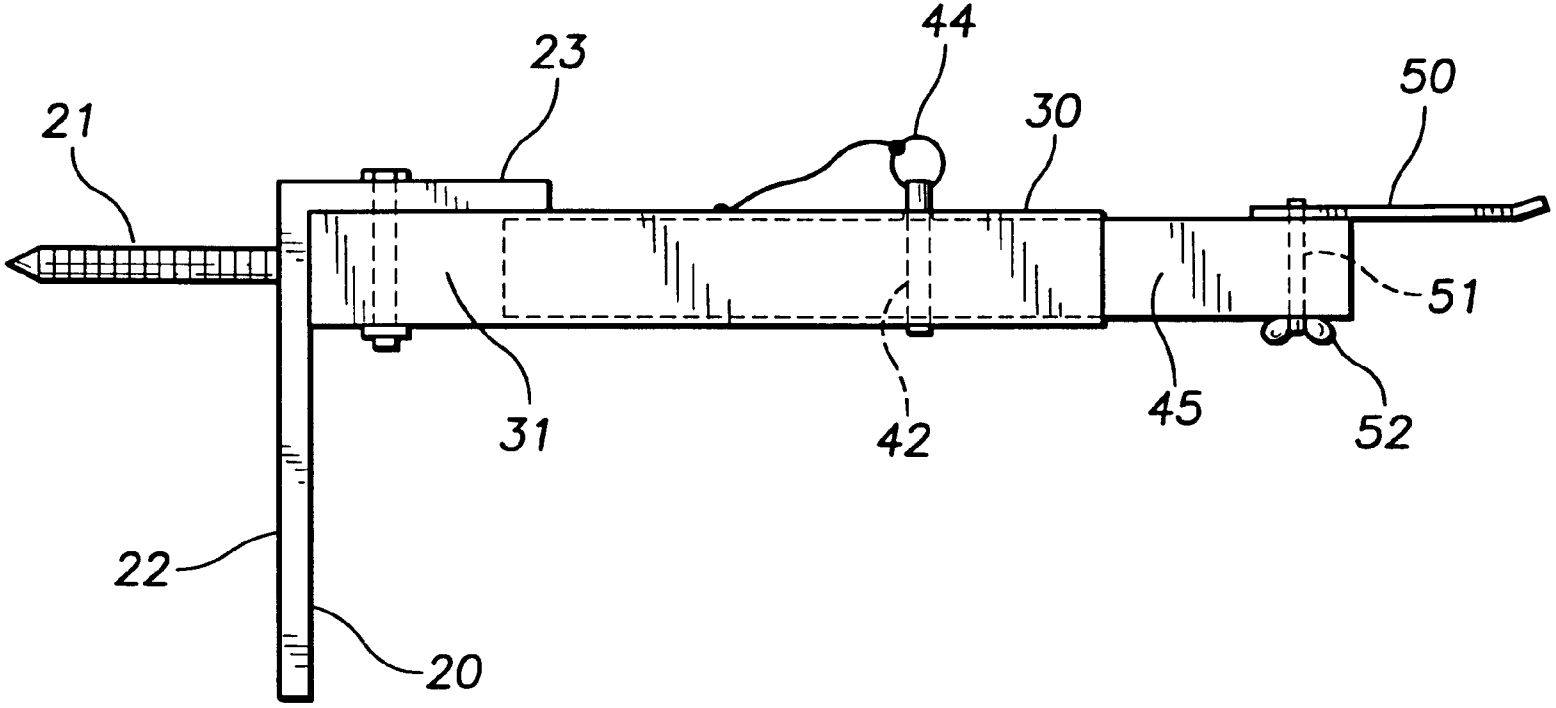
FIG. 2 is a cross sectional side view of the bow hanging apparatus illustrating the extendable tubes and mounting bracket.

Referring to the drawings in detail FIG. 1 is an isometric view of the hunting bow hanger 10 with an "L"-shaped bracket 20, a square aluminum outer tube 30, an extendable inner tube 40 and a pivoting mounting bracket 50.

The "L"-shaped bracket 20 includes a permanently attached lag bolt 21 extending from one end of the "L" shaped bracket 20 and which is used to screwably attach the bow hanger to a post or a tree in any desired location. The lag bolt 21 is preferable a wood screw thread pitch and facilitates the lag bolt to be easily screwed into the tree until the tree contacts surface 22 of the "L"-shaped bracket. The "L"-shaped bracket 20 is preferably constructed of ridged and corrosive resistant metal while the lag bolt 21 is securely attached to the "L"-shaped bracket 20 by welding or any other suitable attachment means. An extended portion 23 of the "L"-shaped bracket 20 provides a mounting means for a square aluminum outer tube 30. The square aluminum outer tube 30 is approximately one inch square and about twelve inches in length. The square aluminum outer tube 30 is fixedly secured to the extended portion 23 of the "L"-shaped bracket 30 by use of bolt 24. The square aluminum outer tube 30 provides a support for an extending inner tube 40 which fits within an interior 31 of the outer tube 30. The extending inner tube 40 has an outside dimension which allows the inner tube 40 to easily slide in or out of the outer tube interior 31. The dimensions of the inner tube are about three quarters of an inch square and about ten inches in length. Both the inner 40 tube and the outer tube 30 include numerous adjustment apertures 43 which are used for adjusting the length extension of the inner tube 40. The positioning of the inner tube 40 extension is maintained by retaining pin 42 which extends through aligned apertures 41 on both the inner and outer tubes. The retaining pin 42 is secured to the outer tube 30 by a tether 44 preventing the pin from becoming lost.

The inner tube 40 includes an inner tube end portion 45 which has mounted thereon a pivoting mounting bracket 50 for mounting a hunting bow. The mounting bracket may also be coated with an anti-scratch coating so that articles are not scratched when supported by the mount. The mounting bracket 50 is pivotally secured to the end 45 by a pivot mount pin 51. The mount pin 51 may be secured in position by a wing nut 52. The mounting end 50 may be pivoted to be in alignment with the inner tube length or perpendicular to the inner tube length as desired. Although the mounting bracket provides a location for hanging a hunting bow, the mounting bracket may be configured to support a number of items, such as a rifle, or any other device which may be supported by the bracket.

It is noted that the embodiment of the Hunting Bow Hanger described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Hunting Bow Hanger comprising:

a) an L shaped bracket with a fixedly secured lag bolt extending from an outside surface of a vertical portion of the bracket thereof, wherein the lag bolt includes a wood screw thread pitch and further wherein the lag bolt is welded to the bracket, b) a square tubular member with one end securely attached to an inside surface of a horizontal portion of the bracket thereon and wherein the tubular member is attached to the bracket utilizing a bolt and screw which extends through the horizontal bracket portion and the square tubular member, numerous length adjustment apertures extending vertically through the square tubular member and aligned longitudinally along a top side of the square tubular member, an open end of the square tubular member;

c) an extending tubular member which has an outside diameter which allows one end to be received by the open end of the square tubular member, numerous length adjustment apertures extending through the extending tubular member and positioned to be aligned with the length adjustment apertures extending through the square tubular member, d) a mounting bracket attached to a mounting end of the extending tubular member which is opposite the end which is received by the square tubular member, the mounting bracket is pivotally attached by a pivot pin to mounting end of the extending tubular member so that the mounting bracket may be altered in orientation as desired, e) a retaining pin with a length long enough to extend through the length adjustment apertures on the square tubular member, so that when the extending tube is extended from the interior of the square tubular member a desired distance the retaining pin is inserted through aligned apertures through both the extending tubular member and the square tubular member, the retaining pin includes a teetered line which is securely attached to an outside surface of the square tubular member so that the retaining pin is not misplaced.

* * * * *